US010166778B2

(12) United States Patent
Rubart et al.

(10) Patent No.: US 10,166,778 B2
(45) Date of Patent: Jan. 1, 2019

(54) REMOVING SEGMENT OF A METAL CONDUCTOR WHILE FORMING PRINTHEADS

(71) Applicant: HEWLETT-PACKARD DEVELOPMENT COMPANY, L.P., Houston, TX (US)

(72) Inventors: Steve Rubart, Corvallis, OR (US); Amy Gault, Corvallis, OR (US); Sean P McClelland, Corvallis, OR (US)

(73) Assignee: HEWLETT-PACKARD DEVELOPMENT COMPANY, L.P., Houston, TX (US)

( * ) Notice: Subject to any disclaimer, the term of this patent is extended or adjusted under 35 U.S.C. 154(b) by 0 days.

(21) Appl. No.: 15/546,823

(22) PCT Filed: Apr. 10, 2015

(86) PCT No.: PCT/US2015/025350
§ 371 (c)(1),
(2) Date: Jul. 27, 2017

(87) PCT Pub. No.: WO2016/164041
PCT Pub. Date: Oct. 13, 2016

(65) Prior Publication Data

US 2018/0022098 A1 Jan. 25, 2018

(51) Int. Cl.
*B41J 2/16* (2006.01)
*B41J 2/04* (2006.01)
*B41J 2/14* (2006.01)

(52) U.S. Cl.
CPC ..... *B41J 2/1626* (2013.01); *B41J 2/04* (2013.01); *B41J 2/14129* (2013.01); *B41J 2/16* (2013.01);
(Continued)

(58) Field of Classification Search
CPC .... B41J 2/1626; B41J 2/14129; B41J 2/1645; B41J 2/1603; B41J 2/1639; B41J 2/1631; B41J 2/164; B41J 2/16; B41J 2/04
See application file for complete search history.

(56) References Cited

U.S. PATENT DOCUMENTS 4,577,202 A 3/1986 Hara
5,485,185 A 1/1996 Sueoka et al.
(Continued)

FOREIGN PATENT DOCUMENTS

CN 1344619 4/2002
CN 1640671 7/2005
(Continued)

OTHER PUBLICATIONS

Aden, Stephen J., et al., The Third-Generation HP Thermal InkJet Printhead, Feb. 1994 Hewlett-Packard Journal, pp. 41-45.

*Primary Examiner* — Sharon A Polk
(74) *Attorney, Agent, or Firm* — HP Inc.—Patent Department

(57) ABSTRACT

An example of a method of forming a printhead includes forming first and second resistors over a first dielectric, forming a first portion of a second dielectric over the first and second resistors and a second portion of the second dielectric over an exposed inclined surface of the first dielectric in a region between the first and second resistors, forming a metal conductor over the first and second portions of the second dielectric, and removing an inclined segment of the metal conductor from an inclined surface of the second portion of the second dielectric to expose the inclined surface of the second portion of the second dielectric.

15 Claims, 11 Drawing Sheets

(52) U.S. Cl.
CPC ..... *B41J 2/1603* (2013.01); *B41J 2/164* (2013.01); *B41J 2/1631* (2013.01); *B41J 2/1639* (2013.01); *B41J 2/1645* (2013.01)

(56) References Cited

U.S. PATENT DOCUMENTS

| | | | | |
|---|---|---|---|---|
| 6,342,448 | B1 | 1/2002 | Lin et al. | |
| 7,160,806 | B2 | 1/2007 | Dodd | |
| 8,158,336 | B2 | 4/2012 | Bell et al. | |
| 2002/0024564 | A1 | 1/2002 | Ozaki et al. | |
| 2004/0087151 | A1* | 5/2004 | Dodd | B41J 2/14129 438/689 |
| 2009/0027450 | A1 | 1/2009 | Park et al. | |
| 2010/0033536 | A1 | 2/2010 | Lee et al. | |
| 2010/0110142 | A1 | 5/2010 | Kwon et al. | |
| 2011/0025785 | A1 | 2/2011 | Chung et al. | |
| 2012/0049324 | A1* | 3/2012 | Le Neel | H01L 21/76834 257/537 |
| 2012/0893587 | | 11/2012 | Bakker et al. | |

FOREIGN PATENT DOCUMENTS

| | | | |
|---|---|---|---|
| CN | 1693080 | A | 11/2005 |
| CN | 1736715 | | 2/2006 |
| CN | 1883945 | A | 12/2006 |
| CN | 1997519 | A | 7/2007 |
| CN | 101332700 | | 12/2008 |
| CN | 101456283 | | 6/2009 |
| CN | 101607472 | | 12/2009 |
| CN | 101765508 | A | 6/2010 |
| EP | 0124312 | | 11/1984 |
| JP | 2005125619 | | 5/2005 |
| JP | 2009178906 | | 8/2009 |
| JP | 2014046543 | | 3/2014 |

* cited by examiner

REMOVING SEGMENT OF A METAL CONDUCTOR WHILE FORMING PRINTHEADS

BACKGROUND

Inkjet printers may include a fluid ejection device, such as a printhead, to eject drops of marking material, such as ink, onto printable media, such as paper. For example, a printhead might eject drops of ink onto the paper while relative movement occurs between the printhead and the paper. In some examples, the drops of ink might be ejected in response to heating the ink, e.g., in examples involving thermal inkjet printheads. In some examples, a printhead might be formed using photoimaging techniques, such as photolithograpy techniques.

DETAILED DESCRIPTION

Printheads, such as thermal inkjet printheads, sometimes include chambers (e.g., sometimes referred to as firing chambers) that are over resistors. During operation, for example, ink that is received in the firing chambers might be heated by the resistors, e.g., in response to dissipating electrical current in the resistors. Heating of the ink may cause a vapor bubble to form in the ink adjacent to a resistor that ejects ink that is above the bubble from the chamber.

In some of the examples discussed herein, a metal conductor may be formed over the resistors and over a region between the resistors. An inclined segment of the metal conductor may then be removed from over the region between the resistors. For example, the inclined segment of the metal conductor may be the result of forming the metal conductor over an inclined surface in the region between the resistors that may form while forming the resistors. The metal conductor may sometimes be called a cavitation layer, for example, in that the metal conductor may act to resist the forces generated due to the repeated collapse of the vapor bubbles that are generated in the ink when the ink is heated by the resistors.

The removal of the inclined segment acts to prevent reflections of electromagnetic radiation, e.g., ultraviolet radiation, from the surface of the inclined segment that may occur during the formation of the firing chambers when the inclined segment is not removed. In some examples, the firing chambers might be formed using photoimaging, such as photolithography. For example, photoimageable material, such as photoresist, might be formed over the resistors and over the region between the resistors. In some examples, the photoimageable material over the region between the resistors may be exposed to the radiation, while the photoimageable material over the resistors is covered, e.g., using a mask.

A solvent, e.g., sometimes called a developer, may then be applied to the photoimageable material to remove the photoimageable material over the resistors that was covered to form the firing chambers over the resistors and to leave the photoimagable material between the resistors that was exposed to the radiation and that cannot be removed by the solvent.

However, in examples where the inclined surface of the metal conductor is not removed from the region between the resistors, the inclined surface may reflect the radiation into the photoimageable material over the resistors that are covered, thereby exposing at least some of the photoimageable material over the resistors to the radiation. As a result, some exposed photoimageable material could remain in the firing chambers over the resistors after applying the solvent, in that the solvent would not remove the exposed photoimageable material.

Figure 1A:
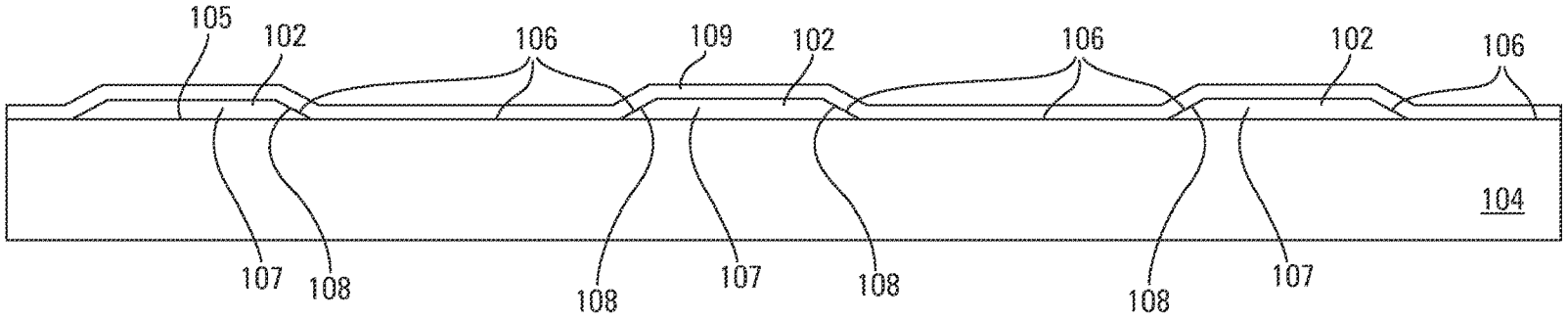
FIGS. 1A-1J are cross-sectional views during various example stages of an example of forming a printhead.

FIGS. 1A-1J are cross-sectional views during various example stages of an example of forming a printhead. In FIG. 1A, a metal conductor 102 (e.g. a layer, such as a thickness, of a conductive metal material), such as aluminum copper (AlCu), is formed over a dielectric 104, such as TEOS (tetraethylorthosilicate). In some examples, metal conductor 102 is formed in direct physical contact with an upper surface 105 of dielectric 104.

Openings 106 are then formed in metal conductor 102 to expose portions of the upper surface 105. For example, openings 106 may be formed by patterning the metal conductor 102 and removing exposed portions of metal conductor 102. For example, a mask (not shown), e.g., imaging resist, such as photoresist, may be formed over metal conductor 102 and patterned to define the portions of metal conductor 102 for removal. The portions of metal conductor 102 defined for removal are subsequently removed, e.g., by etching, to form openings 106 that may terminate at the upper surface 105. In some examples, the removal process causes the remaining portions 107 of metal conductor 102 to have inclined (e.g., sloped, such as angled) sidewalls 108 that also form the inclined sidewalls of openings 106.

A resistive material 109 (e.g. a layer, such as a thickness, of resistive material 109), such as tungsten silicide nitride (WSiN), is then formed in openings 106 over dielectric 104 and over the remaining portions 107 of metal conductor 102. In some examples, the resistive material 109 in openings 106 is formed in direct physical contact with the upper surface 105 of dielectric 104, and the resistive material 109 over the remaining portions 107 of metal conductor 102 is formed in direct physical contact with the upper surfaces and the inclined sidewalls 108 of the remaining portions 107 of metal conductor 102.

In some examples, dielectric 104 might be formed over a semiconductor (not shown), such as silicon. In some examples, other dielectrics (not shown) might be between the semiconductor and dielectric 104.

Figure 1B:
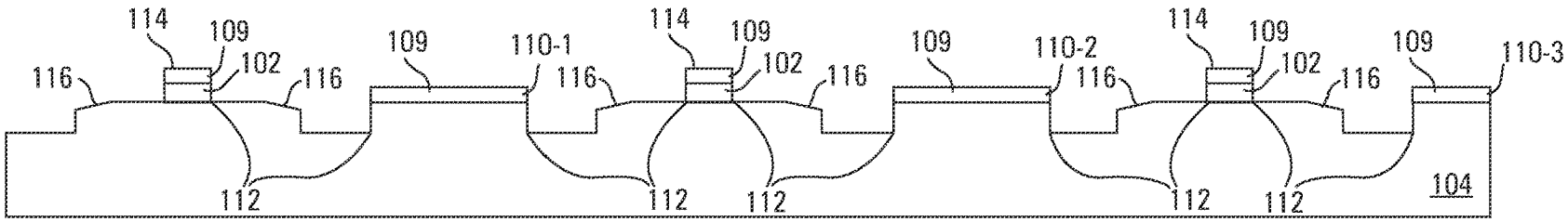

In the example of FIG. 1B, resistors 110 (e.g., resistors 110-1 to 110-3) are formed over dielectric 104 from the resistive material 109 in the openings 106 in metal conductor 102. For example, resistors 110-1 to 110-3 are respectively formed in locations corresponding to the openings 106 in metal conductor 102. Resistors 110 and conductor-resistor (e.g., AlCu—WSiN) stacks 114, including the resistive material 109 over the metal conductor 102, for example, may be formed while removing a portion of the resistive material 109 and a portion of metal conductor 102 from the structure of FIG. 1A to expose surfaces of dielectric 104 in the regions 112 between the resistors 110 and the stacks 114, as shown in FIG. 1B.

In some examples, the resistors 110 and the stacks 114 may be formed by patterning resistive material 109 in the openings 106, corresponding to the resistors 110, and patterning resistive material 109 over the remaining portions 107 of conductor 102, corresponding to the stacks 114. Exposed portions of resistive material 109 in the openings 106 are removed, leaving the resistors 110, and the exposed portions of the resistive material 109 and portions of the remaining portions 107 of conductor 102 under the exposed portions of the resistive material 109 are removed, leaving the stacks 114, as shown in FIG. 1B.

For example, a mask (not shown), e.g., imaging resist, such as photoresist, may be formed over resistive material 109 and patterned to define the portions of resistive material 109 and the portions of the remaining portions 107 of conductor 102 under resistive material 109 for removal. The portions of resistive material 109 and the portions of the remaining portions 107 of conductor 102 under resistive material 109 defined for removal are subsequently removed, e.g., by etching, such as dry etching, leaving resistors 110 and stacks 114.

The removal process continues until the portions of the remaining portions 107 of conductor 102 defined for removal are removed. This causes some of dielectric 104 to be removed. The removal of dielectric 104 causes dielectric 104 to have exposed inclined (e.g., sloped, such as angled) surfaces 116 (e.g. that may be inclined by about 5 to about 10 degrees from the horizontal in FIG. 1B) in the regions 112 between the resistors 110 and the stacks 114. Note that the inclinations of inclined surfaces 116 in FIG. 1B and subsequent figures are not to scale.

Note that the inclined surfaces 116 are between adjacent (e.g., successively adjacent) resistors 110, such as between resistors 110-1 and 110-2 and between resistors 110-2 and 110-3. Inclined surfaces 116 are, at least in part, due to the removal of the inclined sidewalls 108 of the remaining portions 107 of conductor 102. For example, the removal of resistive material 109 and conductor 102 may form the inclined surfaces 116.

In some examples, the conductors 102 in the stacks 114 might be electrically coupled to respective ones of the resistors 110-1 to 110-3. For example, the conductors 102 in the stacks 114 might form the return portion of an electrical circuit that supplies current to resistors 110-1 to 110-3 to cause heating of resistors 110-1 to 110-3.

Figure 1C:
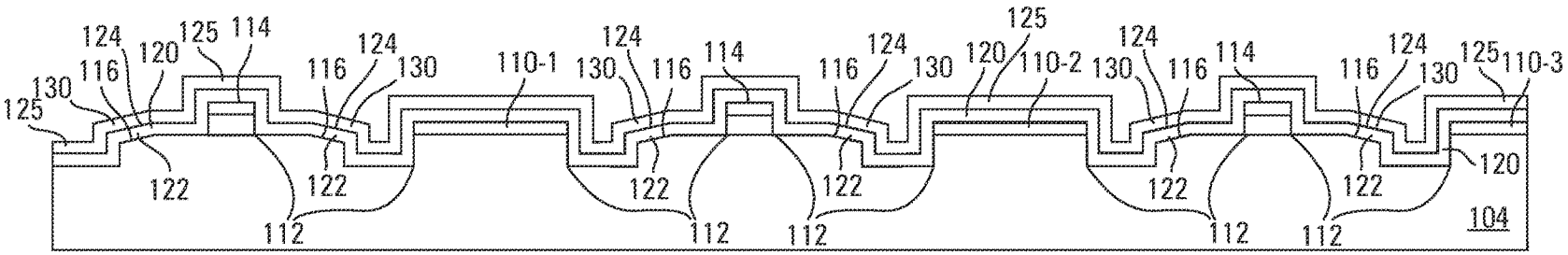

A dielectric 120 (e.g. a layer, such as a thickness, of dielectric material), such as silicon carbide (SiC) or silicon nitride ($Si_3N_4$) or a combination of silicon carbide and silicon nitride, is formed over the structure of FIG. 1B, as shown in the example of FIG. 1C. Dielectric 120, for example, is formed over resistors 110, the exposed dielectric 104, and stacks 114. For example, a portion of dielectric 120 is formed over resistors 110-1 to 110-3 and another portion of dielectric 120 is formed over the exposed inclined surfaces 116 of dielectric 104 in the region between successively adjacent resistors 110-1 and 110-2 and in the region between successively adjacent resistors 110-2 and 110-3. In some examples, dielectric 120 might be referred to as a passivation material, such as a passivation dielectric, and may at least act to protect underlying structures, such as resistors 110-1 to 110-3 and dielectric 104 from adverse effects of inks.

In some examples, the portion of dielectric 120 formed over resistors 110-1 to 110-3 is formed in direct physical contact with (e.g., with upper surfaces of) resistors 110-1 to 110-3, and the portion of dielectric 120 formed over the exposed inclined surfaces 116 of dielectric 104 is formed in direct physical contact with the inclined surfaces 116 of dielectric 104. In some examples, inclined portions (e.g. inclined segments) 122 of dielectric 120, having inclined surfaces 124, are over (e.g., directly over) and in direct physical contact with the inclined surfaces 116 of dielectric 104, as shown in FIG. 1C.

A metal conductor 125 (e.g. a layer, such as a thickness, of a conductive metal material), such as tantalum or a stack including tantalum, platinum over the tantalum, and tantalum over the platinum, etc., is formed over dielectric 120 in the example of FIG. 1C. For example, metal conductor 125 is formed over the portion of dielectric 120 that is formed over resistors 110-1 to 110-3 and the other portion of dielectric 120 that is formed over the inclined surfaces 116 of dielectric 104 in the region between successively adjacent resistors 110-1 and 110-2 and in the region between successively adjacent resistors 110-2 and 110-3. In some examples, metal conductor 125 is formed in direct physical contact with the surface, e.g., the upper surface, of dielectric 120. In some examples, metal conductor 125 includes inclined segments 130 that are over (e.g., directly over) and in direct physical contact with the inclined surfaces of 124 of the inclined portions 122 of dielectric 120. In some examples, dielectric 120 may act to electrically isolate resistive materials, such as resistive material 109, and other conductors (not shown) from metal conductor 125.

Figure 1D:
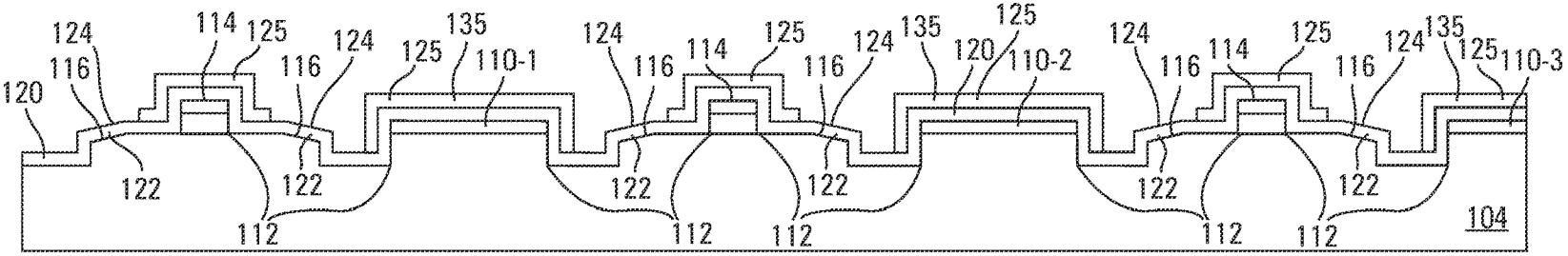

Portions of metal conductor 125 are removed from the structure of FIG. 1C, as shown in the example of FIG. 1D. For example, the inclined segments 130 of conductor 125 are removed from the inclined surfaces 124 of the inclined portions 122 of dielectric 120 in the regions 112 between the resistors 110 and the stacks 114 to expose the inclined surfaces 124 of the inclined portions 122 of dielectric 120 in the regions 112, as shown in FIG. 1D. That is, for example, the inclined segments 130 are removed from the inclined portions 122 (e.g., the inclined surfaces 124 of the inclined portions 122) of dielectric 120 that are in the region between successively adjacent resistors 110-1 and 110-2 and that are in the region between successively adjacent resistors 110-2 and 110-3. Note that the removal of the inclined segments 130 does not act to electrically isolate conductor 125.

In some examples, metal conductor 125 may be patterned and exposed portions of metal conductor 125 are removed, e.g., stopping on dielectric 120. For example, a mask (not shown), e.g., imaging resist, such as photoresist, may be formed over metal conductor 125 and patterned to define the portions of metal conductor 125 for removal. The portions of metal conductor 125 defined for removal are subsequently removed, e.g., by etching, such as dry etching or wet etching, leaving the remaining portions metal conductor 125 over resistors 110-1 to 110-3 and, in the example of FIG. 1D, over stacks 114.

The portions of metal conductor 125 that respectively remain over resistors 110-1 to 110-3 might be referred to as cavitation plates 135, for example. Cavitation plates 135, and thus the portions metal conductor 125 that respectively remain over resistors 110-1 to 110-3, act to resist the forces generated due to the repeated collapse of the vapor bubbles that are generated in the ink when the ink is heated by the resistors. The vapor bubbles act to eject ink that is above the bubbles from the print head.

Figure 2A:
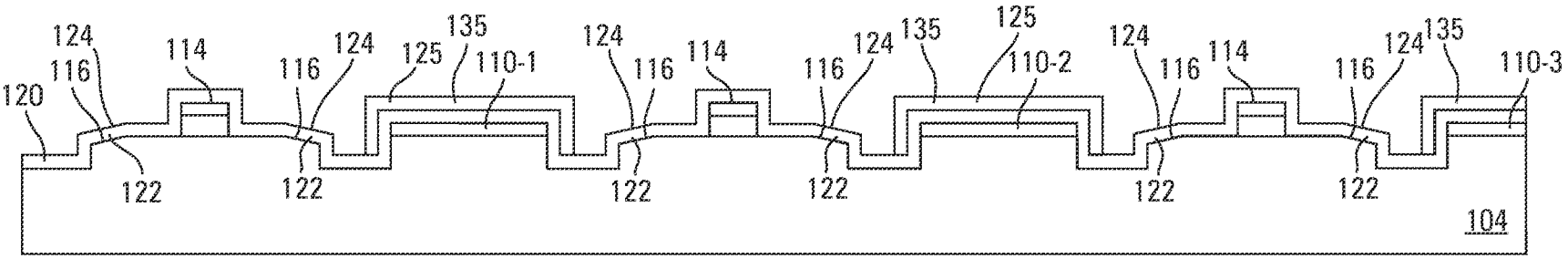
FIGS. 2A-2B are cross-sectional views during various example stages of an example of forming a printhead.

In some examples, such as the example of FIG. 2A, the metal conductor 125 is also removed from a portion of dielectric 120 that is over the stacks 114 while the inclined segments 130 of conductor 125 are removed from the inclined surfaces 124 of dielectric 120. That is, in the example of FIG. 2A, the inclined segments 130 of conductor 125, as in FIG. 1C, are removed from the inclined surfaces 124 of dielectric 120 and from the portion of dielectric 120 that is over the stacks 114.

Figure 1E:
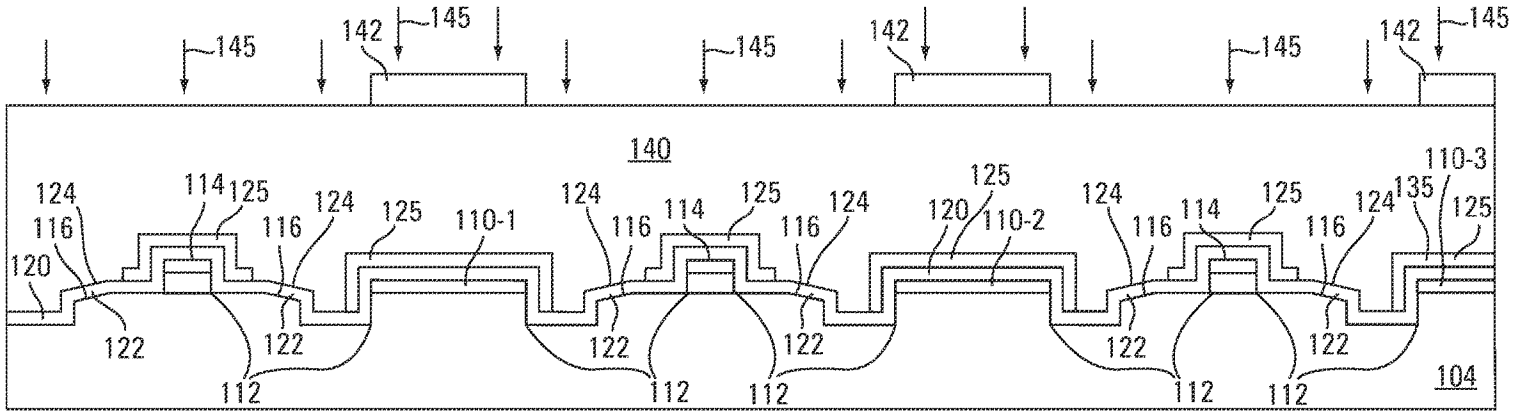

A photoimageable material (e.g., a dielectric) 140 (e.g. a layer, such as a thickness, of photoimageable material 140), such as SU-8 photoresist, is formed over the structure of FIG. 1D, as shown in the example of FIG. 1E. For example, photoimageable material 140 might be formed using a spin-on process, such as a vacuum spin-coating process, or a dry-film lamination process.

A mask 142 is formed over photoimageable material 140 so that regions over (e.g., directly over) resistors 110-1 to 110-3 are covered by mask 142. Electromagnetic radiation 145, such as ultraviolet radiation (e.g., having a wavelength of about 365 nanometers), is directed onto photoimageable material 140 and mask 142 to expose the regions of photoimageable material 140 uncovered by mask 142 to radiation 145 while leaving the regions of photoimageable material 140 covered by mask 142 unexposed by radiation 145.

Radiation 145 causes the regions of photoimageable material 140 that are exposed to radiation 145 to crosslink, while the regions of photoimageable material 140 that are unexposed are left uncrosslinked. For example, the term "unexposed" may be taken to include levels of exposure that produce levels of crosslinking that when present in a photoimageable material would allow removal of that photoimageable material by a solvent, e.g., a developer, such as ethyl lactate. The term "uncrosslinked" may be taken include levels of crosslinking that when present in a photoimageable material would allow removal of that photoimageable material by the solvent.

In some examples, an optical absorber (e.g., sometimes referred to as dye) might be added to photoimageable material 140. For example, the optical absorber may act to increase the amount of radiation 145 absorbed by the photoimageable material 140.

Figure 1F:
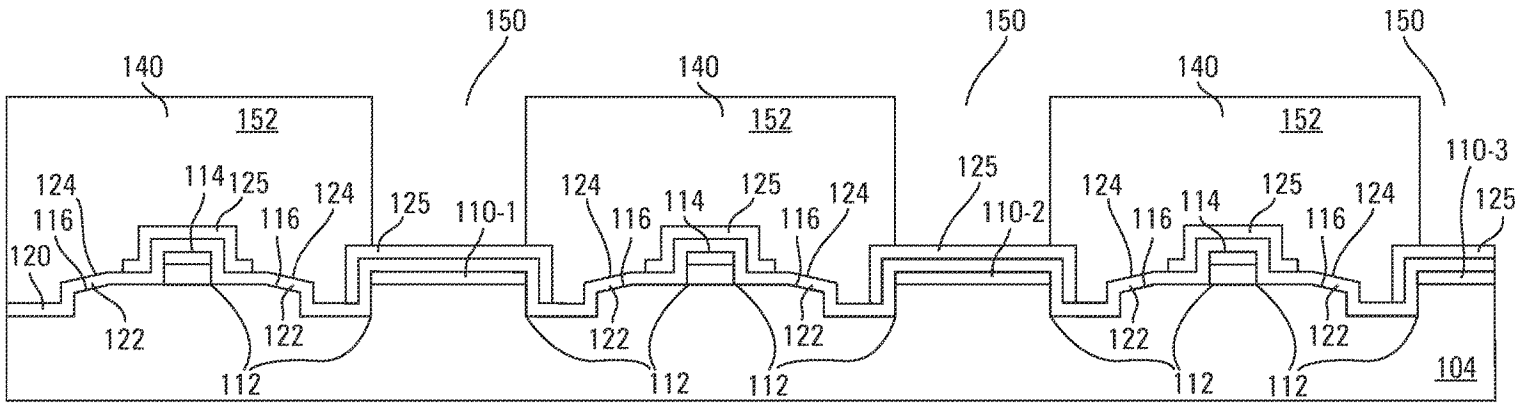

After radiation 145 is applied to the structure of FIG. 1E, the resulting structure, including the crosslinked and uncrosslinked regions, is exposed to the solvent. The solvent forms openings 150 in the uncrosslinked regions by removing the uncrosslinked regions while leaving portions 152 of crosslinked photoimageable material 140, as shown in the example of FIG. 1F.

Openings 150 expose portions of conductor 125 that are over and in direct physical contact with the portions of dielectric 120 that are over and in direct physical contact with resistors 110-1 to 110-3. In some examples, the portions 152 of crosslinked photoimageable material 140 might be referred to as primer portions.

It should be noted that the removal of inclined segments 130 of metal conductor 125 in FIG. 1D from the inclined surfaces 124 of dielectric 120 prevents reflections of the radiation 145 from the surfaces of inclined segments 130 that occur when the inclined segments 130 are not removed from the inclined surfaces 124 of dielectric 120. The inclined segments 130 can reflect a relatively large portion of radiation 145 received thereat to the regions of photoimageable material 140 that are covered by mask 142 that can lead to the formation of crosslinked photoimageable material 140 in the regions covered by mask 142 that might not be removable by the solvent.

The formation of crosslinked photoimageable material 140 in the regions covered by mask 142 can at least limit the size of and/or could potentially prevent the formation of openings 150. For example, the formation of crosslinked photoimageable material 140 in the regions covered by mask 142 might result in the formation of excess crosslinked photoimageable material 140 on the sidewalls of the portions 152 or might form a layer of the crosslinked photoimageable material 140 over the portions of conductor 125 that are over and in direct physical contact with the portions of dielectric 120 that are over and in direct physical contact with resistors 110-1 to 110-3.

However, when the inclined segments 130 are removed, the remaining inclined surfaces 124 of dielectric 120 can at least limit the amount of radiation 145 that is reflected to the regions of photoimageable material 140 that are covered by mask 142, relative to the amount of radiation 145 reflected by inclined segments 130, to a level that at least limits the amount of crosslinking to a level where the crosslinked photoimageable material 140 formed under mask 142 does not present a significant impediment to forming openings 150. For example, the region under mask 142 might be substantially free of any crosslinked photoimageable material 140 that cannot be removed by the solvent.

In examples where dielectric 120 is a combination of silicon carbide and silicon nitride and dielectric 104 is TEOS and where conductor 125 is tantalum, the reflectivity the inclined portion 122 of dielectric 120 over dielectric 104 is about 60 percent less than the reflectivity of inclined segments 130 of metal conductor 125, e.g., for radiation wavelengths of 365 nanometers, plus or minus 10 nanometers.

Figure 1G:
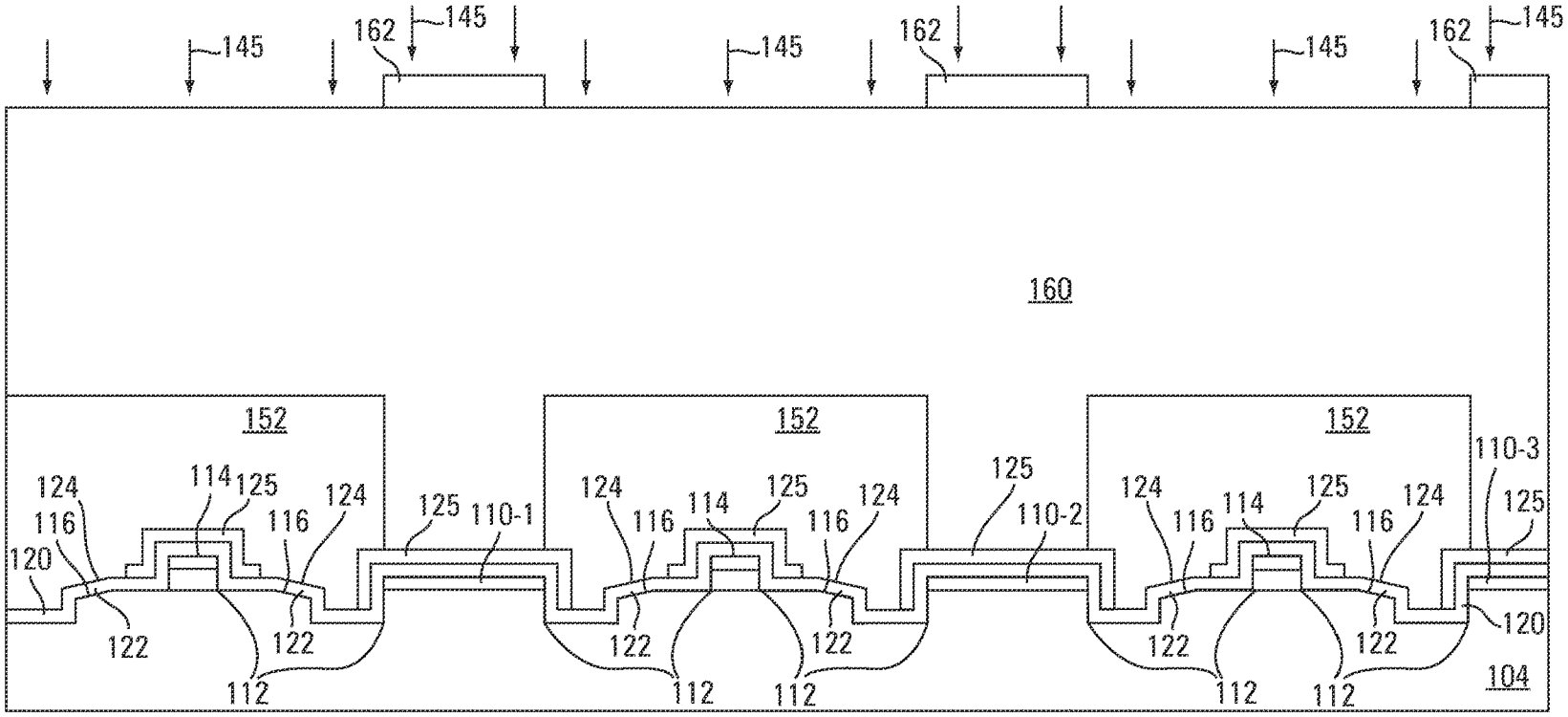

A photoimageable material (e.g., a dielectric) 160 (e.g. a layer, such as a thickness, of photoimageable material 160), such as SU-8 photoresist, is formed over the structure of FIG. 1F, filling the openings 150, as shown in the example of FIG. 1G. For example, photoimageable material 160 might be formed using a spin-on process, such as a vacuum spin-coating process, or a dry-film lamination process.

A mask 162 is formed over photoimageable material 160 so that regions over (e.g., directly over) resistors 110-1 to 110-3 are covered by mask 162. Radiation 145 is directed onto photoimageable material 160 and mask 162 to expose the regions of photoimageable material 160 uncovered by mask 162 to radiation 145 while leaving the regions of photoimageable material 160 covered by mask 162 unexposed by radiation 145. Radiation 145 causes the regions of photoimageable material 160 that are exposed to radiation 145 to crosslink, while the regions of photoimageable material 160 that are unexposed are left uncrosslinked.

Figure 1H:
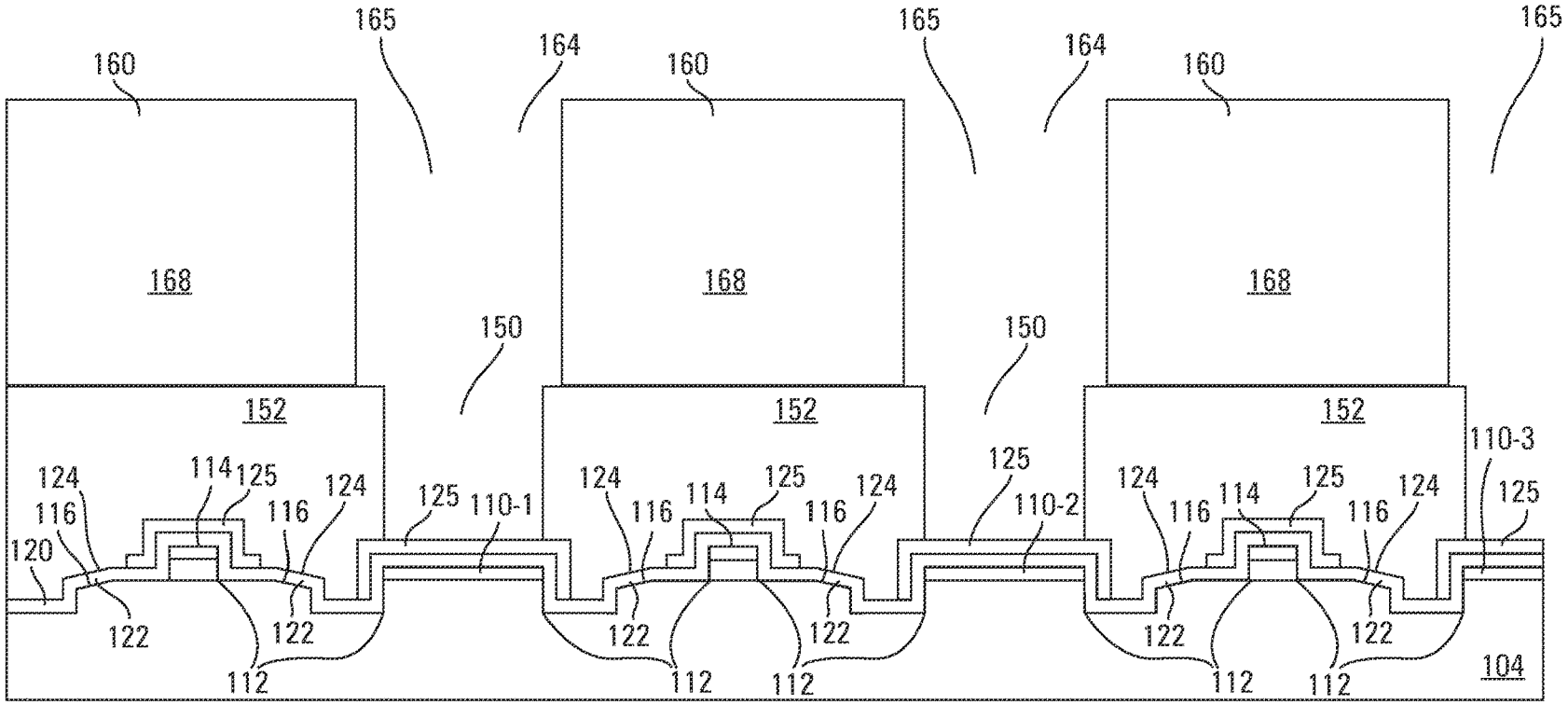

After radiation 145 is applied to the structure of FIG. 1G, the resulting structure, including the crosslinked and uncrosslinked regions, is exposed to the solvent. As shown in the example of FIG. 1H, the solvent reopens openings 150 and forms openings 164 that are over and contiguous with openings 150 in the uncrosslinked regions by removing the uncrosslinked regions, while leaving the portions 168 of crosslinked photoimageable material 160 over the portions 152 of crosslinked photoimageable material 140.

Contiguous openings 150 and 164 form single continuous openings 165 that expose portions of conductor 125 that are over and in direct physical contact with the portions of dielectric 120 that are over and in direct physical contact with resistors 110-1 to 110-3. In some examples, the portions 168 might be referred to as chamber portions.

The removal of inclined segments 130 of metal conductor 125 from the inclined surfaces 124 of dielectric 120 in FIG. 1D prevents reflections of the radiation 145 from the surfaces of inclined segments 130 that occur when the inclined segments 130 are not removed to the regions of photoimageable material 160 that are covered by mask 162. These reflections can lead to the formation of crosslinked photoimageable material 160 in the regions covered by mask 162 that might not be removable by the solvent.

The formation of crosslinked photoimageable material 160 in the regions covered by mask 162 can at least limit the size of and/or could potentially prevent the formation of openings 164. For example, the formation of crosslinked photoimageable material 160 in the regions covered by mask 162 might result in the formation of excess crosslinked photoimageable material 160 on the sidewalls of the portions 168, or might form a layer across openings 164 or might form a layer of the crosslinked photoimageable material 160 over the portions of conductor 125 that are over and in direct physical contact with the portions of dielectric 120 that are over and in direct physical contact with resistors 110-1 to 110-3.

However, when inclined segments 130 are removed, the remaining inclined surfaces 124 of dielectric 120 can at least limit the amount of radiation 145 that is reflected to the regions of photoimageable material 160 that are covered by mask 162, relative to the amount of radiation 145 reflected by inclined segments 130, to a level that at least limits the amount of crosslinking to a level where the crosslinked photoimageable material 160 formed under mask 162 does not present a significant impediment to forming openings 150 and 164. For example, the region under mask 162 might be substantially free of any crosslinked photoimageable material 160.

Figure 1I:
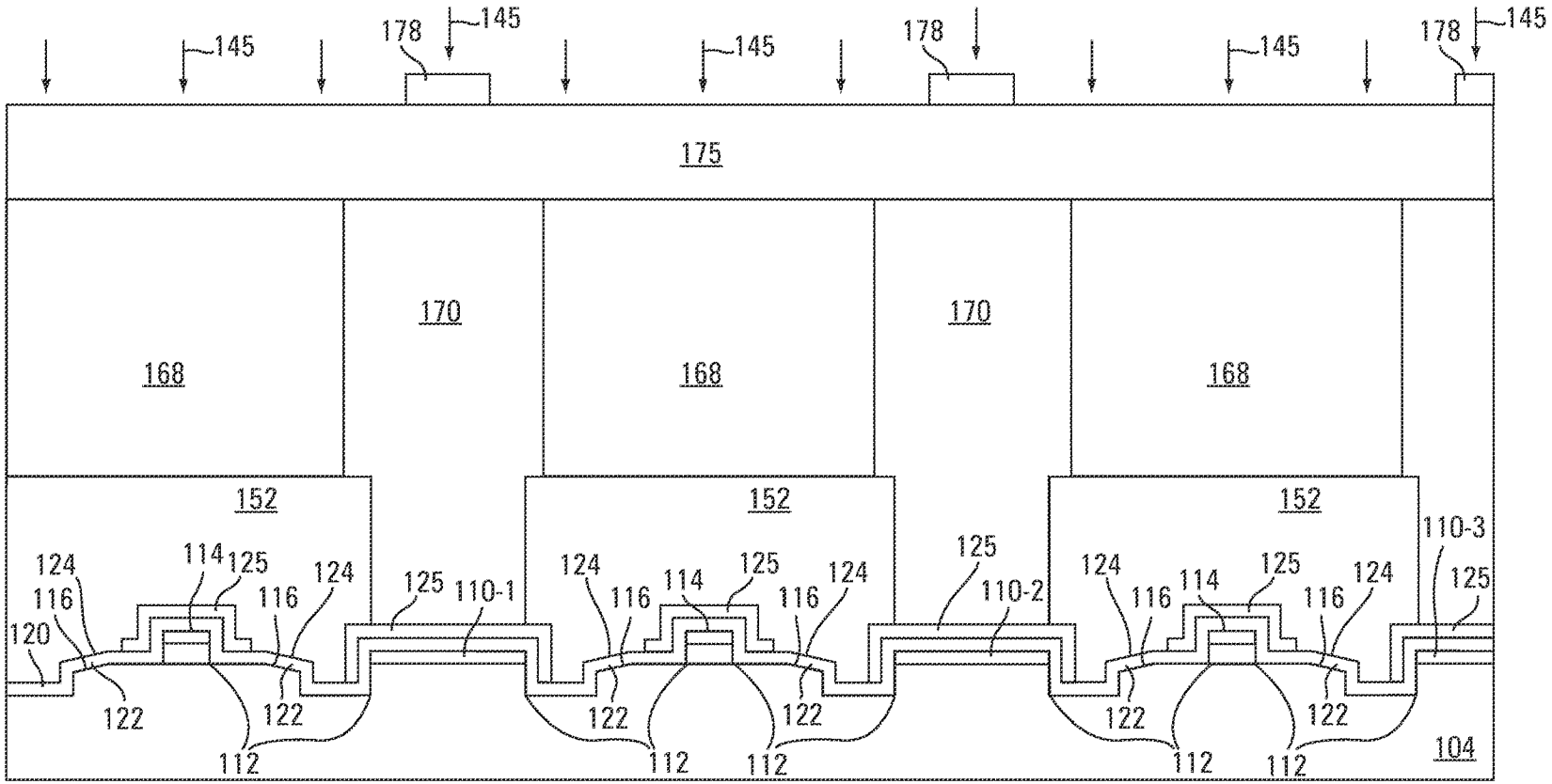

A sacrificial material 170, such as wax, is formed in openings 165 of FIG. 1H, as shown in the example of FIG. 1I. For example, sacrificial 170 might overfill openings 165 and extend over upper surfaces of the portions 168 of crosslinked photoimageable material 160. The sacrificial material 170 is then removed from the upper surfaces of the portions 168, e.g., by chemical mechanical planarization (CMP), so that the upper surfaces of sacrificial material 170 are flush with the upper surfaces of the portions 168, as shown in FIG. 1I.

A photoimageable material (e.g., a dielectric) 175 (e.g. a layer, such as a thickness, of photoimageable material 175), such as SU-8 photoresist, is formed over the upper surfaces of portions 168 and the upper surfaces of sacrificial material 170, as shown in FIG. 1I. For example, photoimageable material 175 might be formed using a spin-on process, such as a vacuum spin-coating process, or a dry-film lamination process.

A mask 178 is formed over photoimageable material 175 so that regions over resistors 110-1 to 110-3 are covered by mask 178. Radiation 145 is directed onto photoimageable material 175 and mask 178. Radiation 145 causes the regions of photoimageable material 175 that are exposed to radiation 145 to crosslink, while the regions of photoimageable material 175 that are unexposed are left uncrosslinked.

Figure 1J:
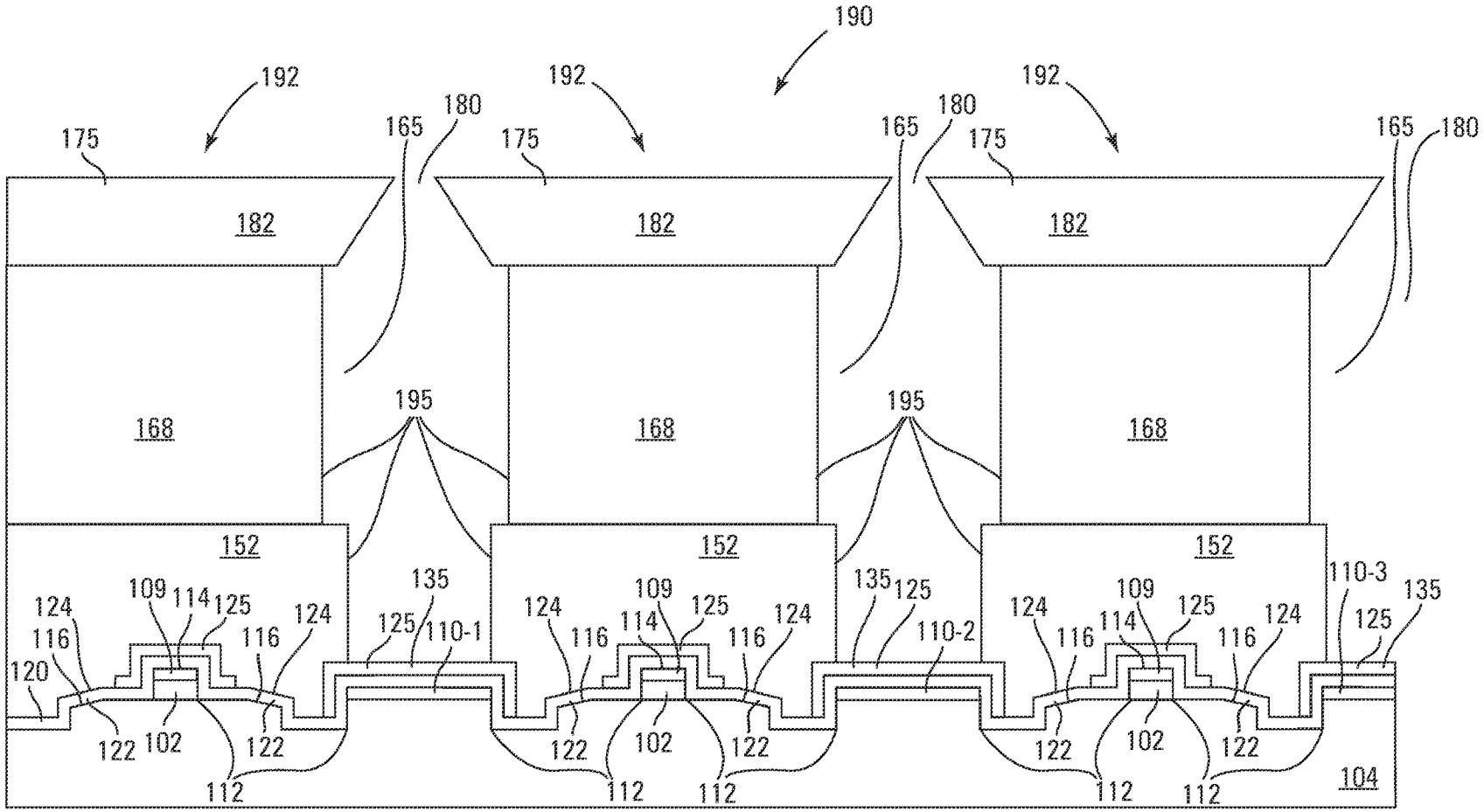

After radiation 145 is applied to the structure of FIG. 1I, the resulting structure, including the crosslinked and uncrosslinked regions, is exposed to the solvent. As shown in the example of FIG. 1J, the solvent reopens openings 165 by removing sacrificial material 170 and forms openings (e.g., orifices) 180 that are over and contiguous with openings 165 in the uncrosslinked regions by removing the uncrosslinked regions, while leaving a layer (e.g., a thickness) 182 of crosslinked photoimageable material 175 over the portions 168 of crosslinked photoimageable material 160. The layer 182 might be referred to as an orifice layer (e.g., an orifice plate) 182, for example. In some examples, layer 182 might be referred to as a tophat layer. Note that FIG. 1J illustrates a portion of an example of a printhead 190.

In some examples, openings 165 may be referred to as firing chambers 165. For example, the respective orifices 180 may provide outlets for the respective firing chambers 165.

In some examples, a portion of the layer 182 of crosslinked photoimageable material 175 over a portion 168 of crosslinked photoimageable material 160 over a portion 152 of crosslinked photoimageable material 140 forms a stack 192 of photoimageable materials that might be referred to as photoimageable material 192. In other examples, photoimageable material 192 might be referred to as a dielectric 192, such as a stack 192 of dielectrics. The sidewalls 195 of successively adjacent dielectrics 192 form sidewalls 195 of the firing chambers 165 between the successively adjacent dielectrics 192.

Figure 2B:
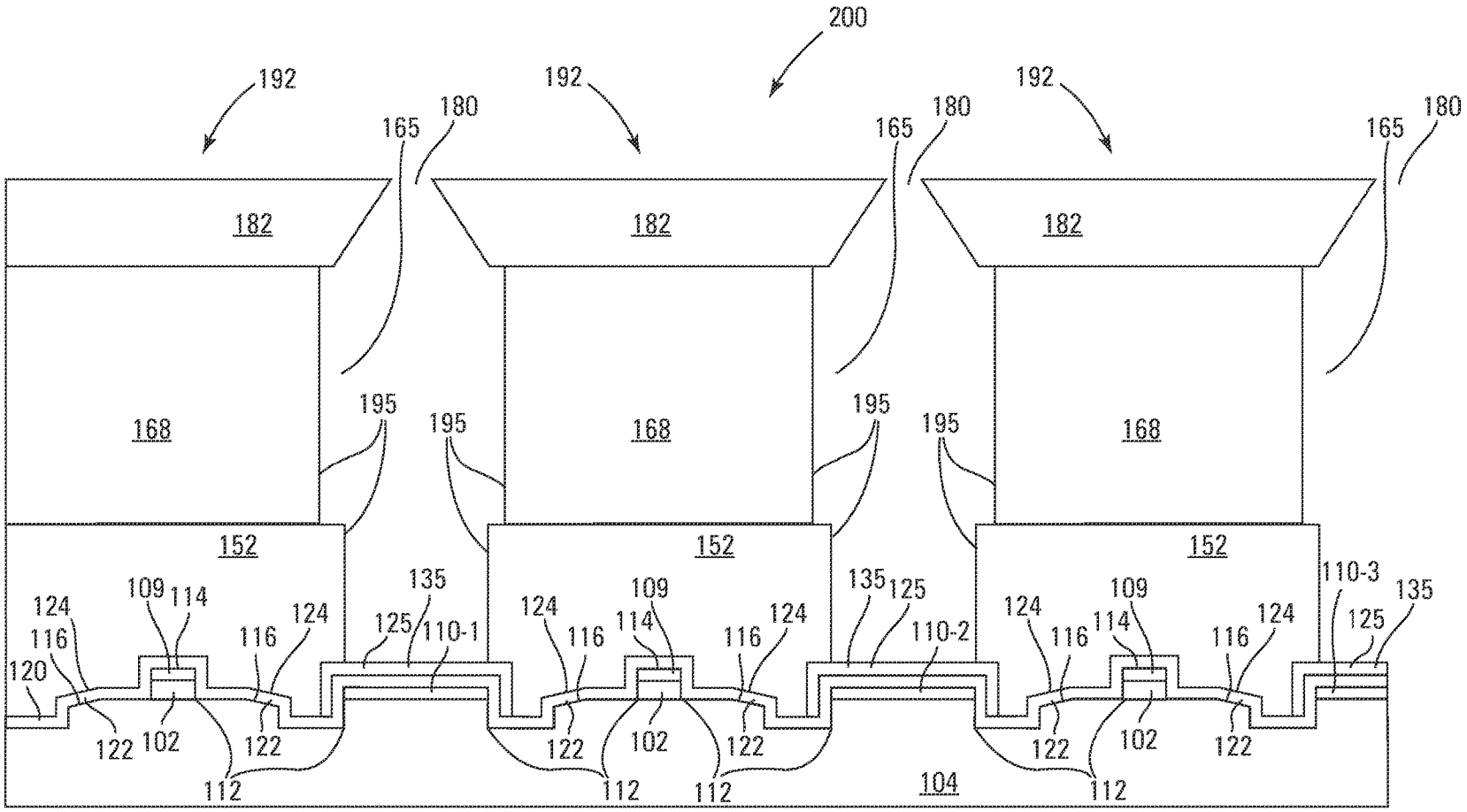

An example of a portion of a printhead 200 is shown in the example of FIG. 2B. Common numbering is used in FIGS. 1J and 2B to illustrate similar (e.g., the same components). Printhead 200, for example, may be formed by forming the portions 152 of crosslinked photoimageable material 140 over the structure of FIG. 2A, e.g., as described in conjunction with FIGS. 1E and 1F, by forming the portions 168 of crosslinked photoimageable material 160 over the portions 152, e.g., as described in conjunction with FIGS. 1G and 1H, and by forming the layer 182 of crosslinked photoimageable material 175 over the portions 168, e.g., as described in conjunction with FIGS. 1I and 1J.

In some examples, printheads 190 and 200 include resistors 110-1 and 110-2 over dielectric 104. Dielectric 120 includes first and second portions respectively over resistors 110-1 and 110-2 and an inclined portion 122 over and in direct physical contact with an inclined surface 116 of dielectric 104 in a region between resistors 110-1 and 110-2 for some examples, as shown in FIGS. 1J and 2B. Respective metal conductors 125 are respectively over the first and second portions of the second dielectric, as shown in FIGS. 1J and 2B. A dielectric 192 between resistors 110-1 and 110-2 is in direct physical contact with the inclined portion 122 of dielectric 120. Opposing sidewalls 195 of the dielectric 192 between resistors 110-1 and 110-2 are respectively sidewalls of the firing chambers 165 respectively over the respective metal conductors 125, as shown in FIGS. 1J and 2B.

In some examples, a metal conductor 102 is over dielectric 104 in the region between resistors 110-1 and 110-2, and the inclined surface 116 of dielectric 104 is between resistor 110-1 and the metal conductor 102, as shown in FIGS. 1J and 2B.

In some examples, the inclined portion 122 is a first inclined portion 122 of dielectric 120, and the dielectric 120 has a third portion over the metal conductor 102 and a second inclined portion 122 over and in direct physical contact with an inclined surface 116 of dielectric 104 that is between resistor 110-2 and metal conductor 102, as shown in FIGS. 1J and 2B.

In some examples, print heads 190 and 200, further include the resistive material 109 between the third portion of dielectric 120 and the metal conductor 102, as shown in FIGS. 1J and 2B. For example, resistive material 109 over a metal conductor 102 forms a stack 114, as shown in FIGS. 1J and 2B.

In some examples, print head 190 further includes a metal conductor 125 over the third portion of dielectric 120, as shown in FIG. 1J. In the example of printhead 200 in FIG. 2B, metal conductor 125 has been removed from the third portion of dielectric 120 that is over the metal conductor 102. That is, for example, the third portion of dielectric 120 that is over metal conductor 102 between resistors 110-1 and 110-2 is devoid of a metal conductor 125 in FIG. 2B.

In some examples of print head 190, the dielectric 192 between resistors 110-1 and 110-2 is in direct physical contact with the second inclined portion 122 of dielectric 120 and in direct physical contact with the conductor 125 over the third portion of dielectric 120, as shown in FIG. 1J.

In some examples, printheads 190 and 200 include a resistor 110, such as resistor 110-2, over dielectric 104. Resistor 110-2 is between a pair of metal conductors 102 that are over dielectric 104. Note that in some examples, the metal conductor 102 is part of a stack 114 that includes the resistive material 109 over conductor 102.

Printheads 190 and 200 include dielectric 120. In some examples, dielectric 120 includes a first portion over resistor 110-2, a second portion over a first one of the pair of metal conductors 102 to the left of resistor 110-2, a third portion over a second one of the pair of metal conductors 102 to the right of resistor 110-2, a first inclined portion 122 over a first inclined upper surface 116 of dielectric 104 in a region (e.g., to the left of resistor 110-2) between the first one the pair of metal conductors 102 and the resistor 110-2 and a second inclined portion 122 over a second inclined upper surface 116 of dielectric 104 in a region (e.g., to the right of resistor 110-2) between the second one of the pair of metal conductors 102 and the resistor 110-2, as shown in FIGS. 1J and 2B. A metal conductor 125 is over the first portion of dielectric 120, for example, as shown in FIGS. 1J and 2B.

In some examples, the second portion of dielectric 120 over the first one of the pair of metal conductors 102 to the left of resistor 110-2 is over and in direct physical contact with the resistive material 109 over the first one of the pair of metal conductors 102, and the third portion of dielectric 120 over the second one of the pair of metal conductors 102 to the right of resistor 110-2 is over and in direct physical contact with the resistive material 109 over the second one of the pair of metal conductors 102, as shown in FIGS. 1J and 2B.

A dielectric 192 on the left of resistor 110-2 has a first portion over the second portion of dielectric 120 and a second portion in direct physical contact with the first inclined portion 122 of dielectric 120, as shown in FIGS. 1J and 2B, for example. A dielectric 192 on the right of resistor 110-2 has a first portion over the third portion of dielectric 120 and a second portion in direct physical contact with the second inclined portion 122 of dielectric 120, as shown in FIGS. 1J and 2B, for example. A firing chamber 165 is over metal conductor 125 and is between the dielectric 192 on the left of resistor 110-2 and the dielectric 192 on the right of resistor 110-2.

In the example of printhead 200 in FIG. 2B, the first portion of the dielectric 192 on the left of resistor 110-2 that is over the second portion of dielectric 120 is in direct physical contact with the second portion of dielectric 120, and the first portion of the dielectric 192 on the right of resistor 110-2 that is over the third portion of dielectric 120 is in direct physical contact with the third portion of dielectric 120.

In the example of printhead 190 in FIG. 1J, a metal conductor 125 is over the first one of the pair of metal conductors 102 to the left of resistor 110-2 and a metal conductor 125 is over the second one of the pair of metal conductors 102 to the right of resistor 110-2. In the example of printhead 190 in FIG. 1J, the second portion of the dielectric 192 on the left of resistor 110-2 in direct physical contact with the first inclined portion 122 of dielectric 120 extends between the metal conductor 125 over resistor 110-2 and the metal conductor 125 that is over the first one of the pair of metal conductors 102 to the left of resistor 110-2, and the second portion of the dielectric 192 on the right of resistor 110-2 in direct physical contact with the second inclined portion 122 of dielectric 120 extends between the metal conductor 125 over resistor 110-2 and the metal conductor 125 that is over the second one of the pair of metal conductors 102 on the right of resistor 110-2.

Figure 3:
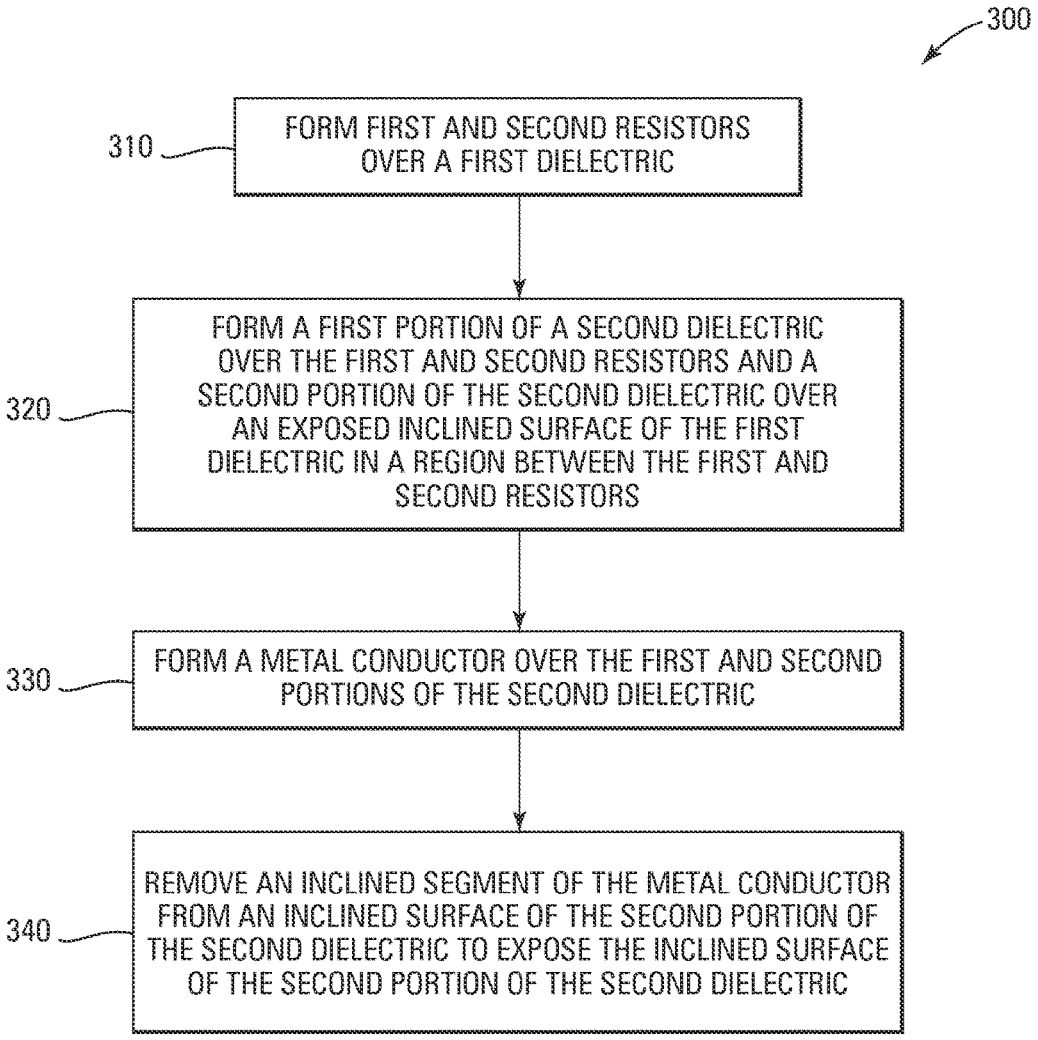
FIG. 3 is flowchart of an example of a method of forming a printhead.

FIG. 3 is a flowchart of an example of a method 300 of forming a printhead. First and second resistors, such as resistors 110-1 and 110-2, are formed over a first dielectric, such as dielectric 104, in block 310. In block 320, a first portion of a second dielectric, such as dielectric 120, is formed over the first and second resistors and a second portion of the second dielectric is formed over an exposed inclined surface, such as inclined surface 116, of the first dielectric in a region between the first and second resistors. A metal conductor, such as metal conductor 125, is formed over the first and second portions of the second dielectric at block 330. In block 340, an inclined segment, such as inclined segment 130, of the metal conductor is removed from an inclined surface, such as inclined surface 124, of the second portion of the second dielectric to expose the inclined surface of the second portion of the second dielectric.

In some examples, the second portion of the second dielectric might be in direct physical contact with the inclined surface of the first dielectric, and forming the metal conductor over the second portion of the second dielectric might include forming the inclined segment of the metal conductor in direct physical contact with the inclined surface of the second portion of the second dielectric.

In some examples, method 300 might further include forming a first portion of a photoimageable material over the first portion of the second dielectric and a second portion of the photoimageable material in the region between the first and second resistors and over the exposed inclined surface of the second portion of the second dielectric, exposing the second portion of the photoimageable material to radiation while covering the first portion of the photoimageable material, and exposing the first and second portions of the photoimageable material to solvent to remove the first portion while leaving the second portion. Removing the inclined segment of the metal conductor acts to prevent reflections of the radiation from a surface of the inclined segment of the metal conductor to the covered first portion of the photoimageable material that occur while the second portion of the photoimageable material is exposed to the radiation when the inclined segment of the metal conductor is not removed.

In some examples, the metal conductor might be a first metal conductor, and method 300 might further include forming a third portion of the second dielectric over a second metal conductor, such as metal conductor 102, that is in the region between the first and second resistors and forming the first metal conductor over the third portion of the second dielectric. In some examples, method 300 might further include removing the first metal conductor from the third portion of the second dielectric while removing the inclined segment of the metal conductor from the inclined surface of the second portion of the second dielectric.

Figure 4:
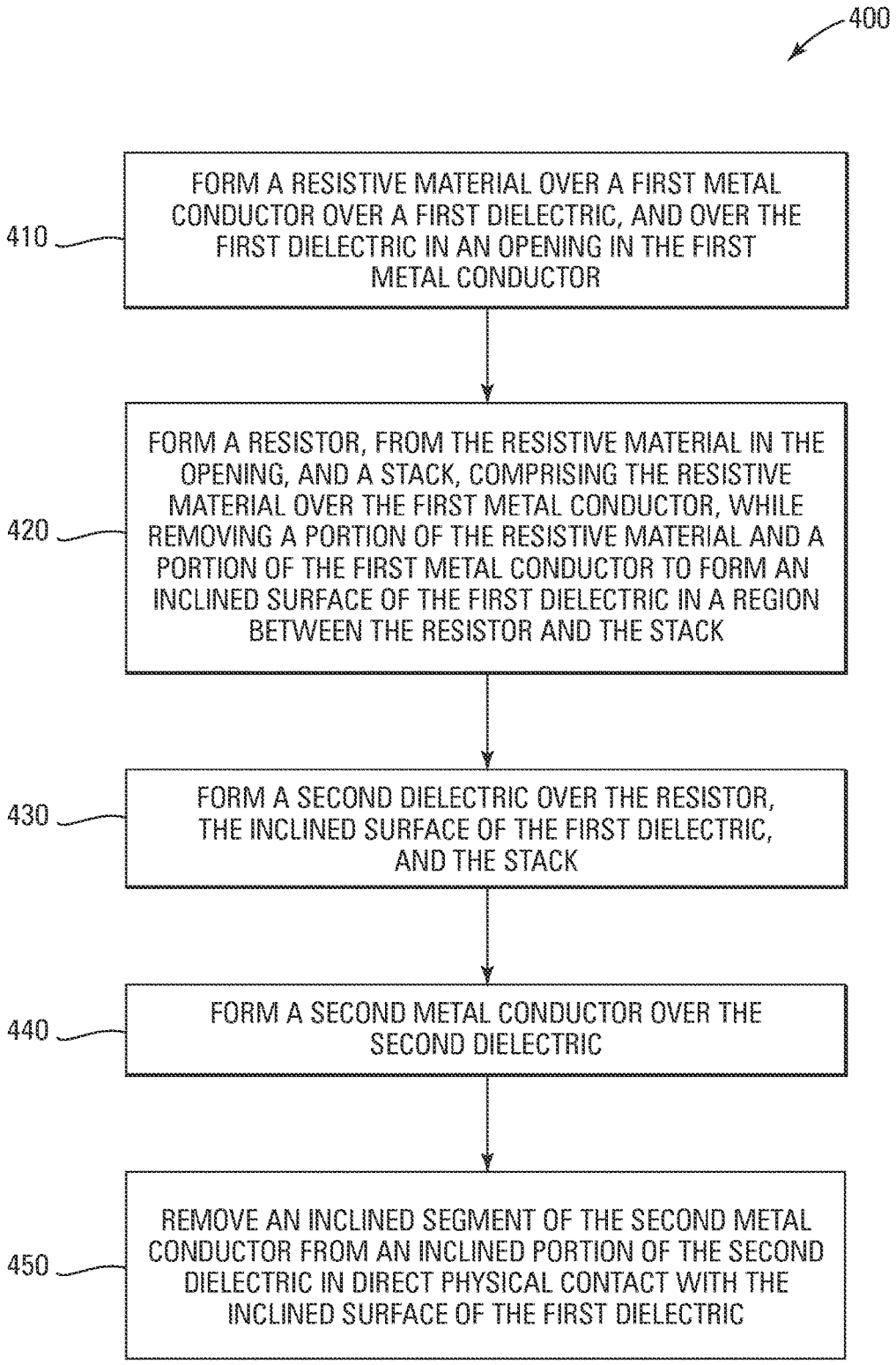
FIG. 4 is flowchart of an example of a method of forming a printhead.

FIG. 4 is a flowchart of an example of a method 400 of forming a printhead. In block 410, a resistive material, such as resistive material 109, is formed over a first metal conductor, such as metal conductor 102, over a first dielectric, such as dielectric 104, and over the first dielectric in an opening, such as an opening 106, in the first metal conductor. At block 420, a resistor, such as a resistor 110, is formed, from the resistive material in the opening, and a stack, such as a stack 114, comprising the resistive material over the first metal conductor, is formed while removing a portion of the resistive material and a portion of the first metal conductor to form an inclined surface, such as inclined surface 116, of the first dielectric in a region between the resistor and the stack. At block 430, a second dielectric, such as dielectric 120, is formed over the resistor, the inclined surface of the first dielectric, and the stack. A second metal conductor, such as metal conductor 125, is formed over the second dielectric in block 440. In block 450, an inclined segment, such as inclined segment 130, of the second metal conductor is removed from an inclined portion, such as inclined portion 122, of the second dielectric in direct physical contact with the inclined surface of the first dielectric.

In some examples, method 400 might further include removing the second metal conductor from a portion of the second dielectric that is over and in direct physical contact with the stack.

Although specific examples have been illustrated and described herein it is manifestly intended that the scope of the claimed subject matter be limited only by the following claims and equivalents thereof.

What is claimed is:

1. A method of forming a printhead, comprising:

forming first and second resistors over a first dielectric;

forming a first portion of a second dielectric over the first and second resistors and a second portion of the second dielectric over an exposed inclined surface of the first dielectric in a region between the first and second resistors;

forming a metal conductor over the first and second portions of the second dielectric; and removing an inclined segment of the metal conductor from an inclined surface of the second portion of the second dielectric to expose the inclined surface of the second portion of the second dielectric.

2. The method of claim 1, wherein the second portion of the second dielectric is in direct physical contact with the inclined surface of the first dielectric, and wherein forming the metal conductor over the second portion of the second dielectric comprises forming the inclined segment of the metal conductor in direct physical contact with the inclined surface of the second portion of the second dielectric.

3. The method of claim 1, wherein removing the inclined segment of the metal conductor does not act to electrically isolate the metal conductor.

4. The method of claim 1, further comprising:

forming a first portion of a photoimageable material over the first portion of the second dielectric and a second portion of the photoimageable material in the region between the first and second resistors and over the exposed inclined surface of the second portion of the second dielectric;

exposing the second portion of the photoimageable material to radiation while covering the first portion of the photoimageable material; and exposing the first and second portions of the photoimageable material to solvent to remove the first portion of the photoimageable material while leaving the second portion of the photoimageable material.

5. The method of claim 4, wherein removing the inclined segment of the metal conductor acts to prevent reflections of the radiation from a surface of the inclined segment of the metal conductor to the covered first portion of the photoimageable material that occur while the second portion of the photoimageable material is exposed to the radiation when the inclined segment of the metal conductor is not removed.

6. The method of claim 1, wherein the metal conductor is a first metal conductor, and further comprising:

forming a third portion of the second dielectric over a second metal conductor that is in the region between the first and second resistors; and forming the first metal conductor over the third portion of the second dielectric.

7. The method of claim 6, further comprising removing the first metal conductor from the third portion of the second dielectric while removing the inclined segment of the metal conductor from the inclined surface of the second portion of the second dielectric.

8. A method of forming a printhead, comprising:

forming a resistive material over a first metal conductor over a first dielectric, and over the first dielectric in an opening in the first metal conductor;

forming a resistor, from the resistive material in the opening, and a stack, comprising the resistive material over the first metal conductor, while removing a portion of the resistive material and a portion of the first metal conductor to form an inclined surface of the first dielectric in a region between the resistor and the stack;

forming a second dielectric over the resistor, the inclined surface of the first dielectric, and the stack;

forming a second metal conductor over the second dielectric; and removing an inclined segment of the second metal conductor from an inclined portion of the second dielectric in direct physical contact with the inclined surface of the first dielectric.

9. The method of claim 8, further comprising removing the second metal conductor from a portion of the second dielectric that is over and in direct physical contact with the stack.

10. A printhead, comprising:

first and second resistors over a first dielectric;

a second dielectric, comprising first and second portions respectively over the first and second resistors and an inclined portion over and in direct physical contact with an inclined surface of the first dielectric in a region between the first and second resistors;

respective metal conductors respectively over the first and second portions of the second dielectric; and a third dielectric between the first and second resistors in direct physical contact with the inclined portion of the second dielectric, wherein opposing sidewalls of the third dielectric are respectively sidewalls of chambers respectively over the respective metal conductors.

11. The printhead of claim 10, wherein the respective metal conductors are respective first metal conductors, and further comprising a second metal conductor over the first dielectric in the region between the first and second resistors, wherein the inclined surface of the first dielectric is between the first resistor and the second metal conductor.

12. The printhead of claim 11, wherein the inclined portion of the second dielectric is a first inclined portion of the second dielectric, and wherein the second dielectric comprises a third portion over the second metal conductor and a second inclined portion over and in direct physical contact with an inclined surface of the first dielectric that is between the second resistor and the second metal conductor.

13. The printhead of claim 12, further comprising a resistive material between the third portion of the second dielectric and the second metal conductor.

14. The printhead of claim 12, further comprising a third metal conductor over the third portion of the second dielectric, wherein the first metal conductors and the third metal conductor are of the same conductive material.

15. The printhead of claim 14, wherein the third dielectric is in direct physical contact with the second inclined portion of the second dielectric and in direct physical contact with the third metal conductor.

* * * * *